US007419571B2

(12) United States Patent
Sakari

(10) Patent No.: US 7,419,571 B2
(45) Date of Patent: Sep. 2, 2008

(54) METHOD FOR CONTROLLING THE TEMPERATURE OF A CELLULOSIC WEB ENTERING A DRYER

(75) Inventor: Vesa Sakari, Pori (FI)

(73) Assignee: Metso Paper, Inc., Helsinki (FI)

( * ) Notice: Subject to any disclaimer, the term of this patent is extended or adjusted under 35 U.S.C. 154(b) by 744 days.

(21) Appl. No.: 10/521,758

(22) PCT Filed: Aug. 27, 2003

(86) PCT No.: PCT/FI03/00627

§ 371 (c)(1),
(2), (4) Date: Jan. 19, 2005

(87) PCT Pub. No.: WO2004/020735

PCT Pub. Date: Mar. 11, 2004

(65) Prior Publication Data

US 2006/0162891 A1 Jul. 27, 2006

(30) Foreign Application Priority Data

Aug. 28, 2002 (FI) ..... 20021535

(51) Int. Cl.
*D21F 1/00* (2006.01)
*D21F 7/00* (2006.01)

(52) U.S. Cl. ..... 162/198; 162/207; 34/338; 34/348; 34/349

(58) Field of Classification Search ..... 162/198, 162/202–207, 212, 208, 263, 301–305; 34/329, 34/337–338, 344, 348–350, 397–40, 359–363, 34/370

See application file for complete search history.

(56) References Cited

U.S. PATENT DOCUMENTS

| | | | | | |
|---|---|---|---|---|---|
| 1,881,404 | A | * | 10/1932 | Hadley | 162/208 |
| 2,838,982 | A | * | 6/1958 | Dupasquier | 162/290 |
| 3,089,252 | A | * | 5/1963 | Daane et al. | 34/114 |
| 3,795,578 | A | * | 3/1974 | Dupasquier | 162/290 |
| 3,945,881 | A | * | 3/1976 | Speidel | 162/208 |
| 4,331,510 | A | * | 5/1982 | Wells | 162/290 |
| 4,977,687 | A | * | 12/1990 | Boissevain | 34/558 |
| 5,736,007 | A | * | 4/1998 | Duffy | 162/53 |
| 6,076,279 | A | * | 6/2000 | Saalasti | 34/397 |
| 6,085,437 | A | * | 7/2000 | Stipp | 34/115 |
| 6,365,004 | B1 | * | 4/2002 | Hamstrom et al. | 162/198 |
| 2002/0162243 | A1 | * | 11/2002 | Runge et al. | 34/444 |
| 2006/0162891 | A1 | * | 7/2006 | Sakari | 162/207 |

FOREIGN PATENT DOCUMENTS

| | | | |
|---|---|---|---|
| CA | 2 293 300 | | 11/1999 |
| WO | WO 99/55958 | | 11/1999 |
| WO | WO 2004/020735 | A1 * | 3/2004 |

* cited by examiner

*Primary Examiner*—José A Fortuna
(74) *Attorney, Agent, or Firm*—Buchanan Ingersoll & Rooney PC

(57) ABSTRACT

The invention relates to a method for controlling the temperature of a web, which is formed from cellulosic pulp and is to be passed to a dryer, by way of applying temperature-controlled liquid to the web. According to the invention, the thus formed web is passed into a closed space defined by two wires and side deckles, wherein temperature-controlled liquid is applied at controlled pressure and flow rate through the wire to the web.

20 Claims, 1 Drawing Sheet

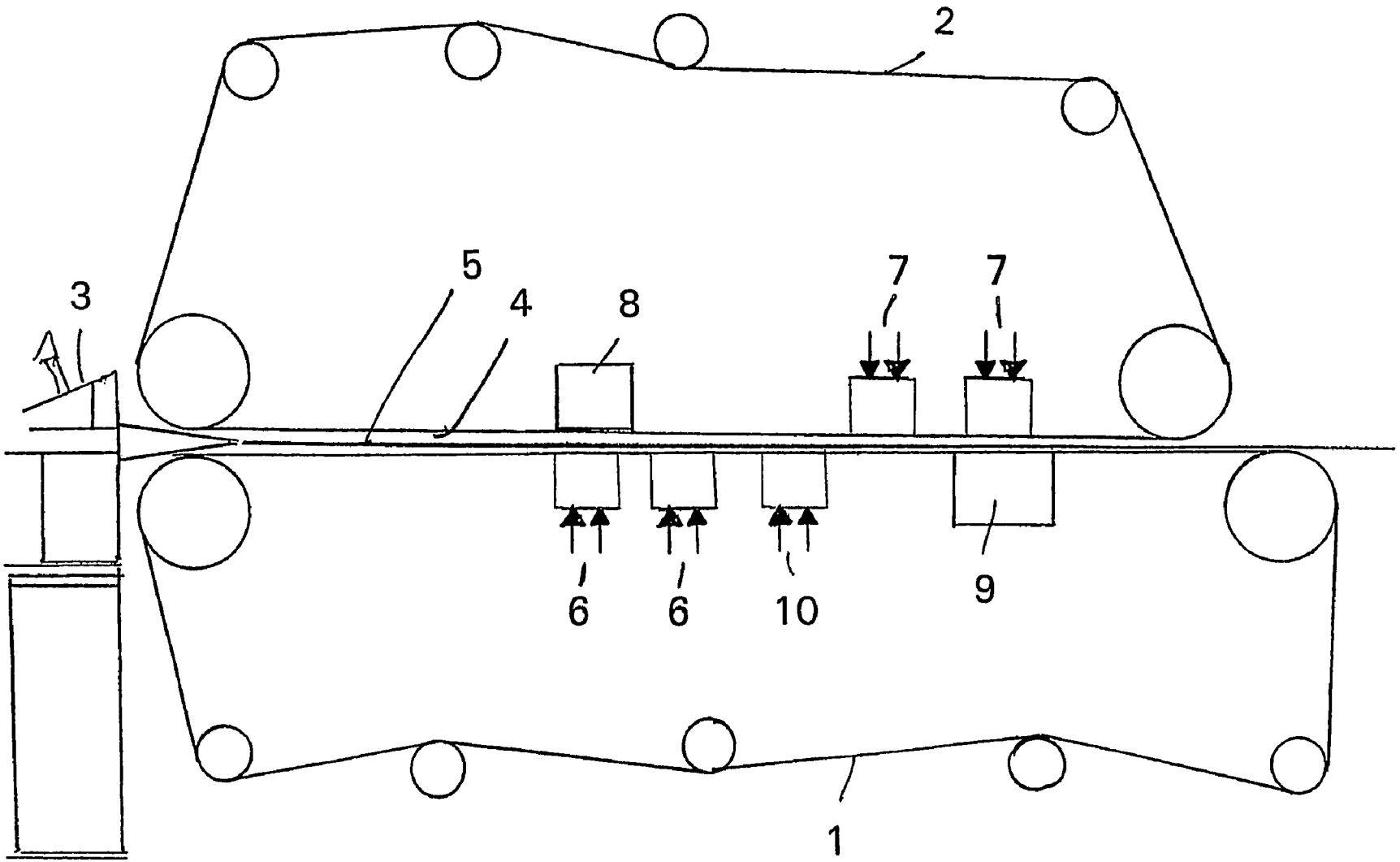
1
2
3
4
5
6
6
7
7
8
9
10

METHOD FOR CONTROLLING THE TEMPERATURE OF A CELLULOSIC WEB ENTERING A DRYER

FIELD OF THE INVENTION

The present invention relates to a method for controlling the temperature of a web, which is formed from cellulosic pulp and is to be passed to a dryer, by way of applying temperature-controlled liquid to the web when passed into a closed space, wherein said temperature-controlled liquid is applied at controlled pressure and flow rate to the web.

BACKGROUND OF THE INVENTION

Conventionally, a traveling cellulosic web has been heated by flooding the web with a liquid, whereby uncontrollable penetration of the liquid into the web occurs. As this overflow-flooding step of heating takes place in an open space, it is hampered by problems from the overflow of the liquid and release of expansion steams.

It is an object of the present invention to overcome the above-mentioned problems by virtue of a method characterized in that said closed space is defined by two wires and side deckles, and that said liquid is applied through the wires into the web both from below the bottom wire and from above the top wire.

SUMMARY OF THE INVENTION

Generally, the closed spaced remaining between the wires is maintained at a moderate positive pressure. The method according to the invention is capable of controllably setting the web temperature at a desired level, e.g., close to 100° C., thus improving water removal from the web in the press section next downstream of the closed space, whereby the web is maximally hot and has a high solids content at the instant the web enters the dryer section. Furthermore, the method according to the invention may be applied generally in the temperature control of a web, even for cooling, thus making it possible to set the web temperature optimally for drying a cellulosic web. The method also facilitates addition of chemicals into the web in order to improve the qualities of the web.

According to the invention, the liquid can be applied via boxes to the web, both from the underside of the lower wire and from the top side of the upper wire either simultaneously or alternatingly. The penetration of the liquid being applied into the web may be improved if so desired by way of maintaining a pressure difference between the liquid application point and the side of the web opposite to the application point. This arrangement can be accomplished using, e.g., suction boxes that are located on the opposite side of the web relative to the liquid application point, substantially aligned with said point.

There may be located a plurality of liquid feed points above and below the web, preferably in alternating positions.

As the web enters the closed space between the wires, its solids content is in a range of about 0.5% to about 4.0%, while the solids content is in a range of about 20% to about 30% when the web exits the closed space and enters the press section.

BRIEF DESCRIPTION OF THE DRAWINGS

In the following, the invention will be described in greater detail by making reference to the appended drawing.

FIG. 1 shows a schematic side elevation view of an apparatus layout suitable for implementing the method of according to the invention.

DETAIL DESCRIPTION OF THE INVENTION

The method employs a twin-wire machine having a bottom wire 1 and top wire 2. Cellulosic pulp is fed into the headbox 3 of the twin-wire machine, wherefrom the pulp flows as a uniform sheet into a closed space 4 defined by the bottom wire 1 and the top wire 2 in cooperation with side deckles (not shown), wherein a web 5 is formed. When entering this closed space 4, the solids content of the web is typically in a range of about 0.5% to about 4.0%. This closed space 4 is generally maintained at a moderate positive pressure.

In order to control the temperature of the web 5 to a desired level, below the bottom wire 1 and/or above the top wire 2 are placed liquid feed points 6, 7, 10 wherefrom to the web 5 is applied a liquid advantageously via a box at a controlled temperature, pressure and flow rate. As shown in the drawing, the liquid is applied to the web 5 first from below the bottom wire 1 at liquid feed points 6 and 10, whereupon liquid application takes place from above the top wire 2 at liquid feed points 7. Obviously, the apparatus may incorporate more liquid feed points either above or below the web or in alternating positions both above and below the web.

When necessary, the penetration of the liquid being applied into the web 5 can be improved by means of suction boxes 8, 9 adapted to operate opposite to some or each one of the liquid feed points 6, 7, 10, substantially aligned with the opposed liquid feed point.

According to an embodiment of the invention, the web is heated in the method of the invention to a temperature close to 100°, whereby the removal of water from the web 5 is enhanced in the press section located downstream of the twin-wire region. Resultingly, the temperature and solids content of the web are elevated maximally high as the web enters the dryer section, whereby drying of the web is speeded up and energy consumption of the dryer is lowered.

Alternatively, the method may also be employed for cooling the web 5 in order to set the temperature of the web 5 to an optimal level for drying a cellulosic web.

Furthermore, the method according to the invention facilitates the addition of web quality improving chemicals into the web in conjunction with the liquid being applied to the web, thus allowing the control of, e.g., the pH of the web.

When exiting the closed space 4 defined by the wires 1, 2, the solids content of the web has increased reaching from about 20% to about 30%.

The invention claimed is:

1. A method for controlling the temperature of a web (5), which is formed from cellulosic pulp and is to be passed to a dryer, by way of applying temperature-controlled liquid to the web when passed into a closed space (4), wherein said temperature-controlled liquid (6, 7, 10) is applied at controlled pressure and flow rate to the web (5), wherein said closed space (4) is defined by two wires (1, 2) and side deckles, and that said liquid is applied through the wires (1, 2) into the web both from below the bottom wire (1) and from above the top wire (2).

2. A method according to claim 1, wherein in the closed space (4) between the wires (1, 2) a moderate positive pressure is maintained.

3. A method according to claim 2, wherein the penetration of the liquid being applied into the web (5) is improved by maintaining a pressure difference between the opposite sides of the web.

4. A method according to claim 3, wherein in order to establish said pressure difference, a suction box (8, 9) is adapted to operate opposite to some or to each liquid feed point (6, 7, 10) on the other side of the web, substantially aligned with said liquid feed point (6, 7, 10).

5. A method according to claim 3, wherein the temperature of the web (5) is elevated substantially close to 100° C.

6. A method according to claim 5, wherein in order to establish said pressure difference, a suction box (8, 9) is adapted to operate opposite to some or to each liquid feed point (6, 7, 10) on the other side of the web, substantially aligned with said liquid feed point (6, 7, 10).

7. A method according to claim 3, wherein chemicals are added to the web (5) in conjunction with the liquid application in order to improve the qualities of the web.

8. A method according to claim 3, wherein the solids content of the ingoing web (5) is about 0.5-4.0% and the solids of the outgoing web prior to its entry into the dryer is about 20-30%.

9. A method according to claim 2, wherein the temperature of the web (5) is elevated substantially close to 100° C.

10. A method according to claim 9, wherein in order to establish said pressure difference, a suction box (8, 9) is adapted to operate opposite to some or to each liquid feed point (6, 7, 10) on the other side of the web, substantially aligned with said liquid feed point (6, 7, 10).

11. A method according to claim 2, wherein chemicals are added to the web (5) in conjunction with the liquid application in order to improve the qualities of the web.

12. A method according to claim 2, wherein the solids content of the ingoing web (5) is about 0.5-4.0% and the solids of the outgoing web prior to its entry into the dryer is about 20-30%.

13. A method according to claim 1, wherein the temperature of the web (5) is elevated substantially close to 100° C.

14. A method according to claim 13, wherein in order to establish said pressure difference, a suction box (8, 9) is adapted to operate opposite to some or to each liquid feed point (6, 7, 10) on the other side of the web, substantially aligned with said liquid feed point (6, 7, 10).

15. A method according to claim 13, wherein chemicals are added to the web (5) in conjunction with the liquid application in order to improve the qualities of the web.

16. A method according to claim 13, wherein the solids content of the ingoing web (5) is about 0.5-4.0% and the solids of the outgoing web prior to its entry into the dryer is about 20-30%.

17. A method according to claim 1, wherein chemicals are added to the web (5) in conjunction with the liquid application in order to improve the qualities of the web.

18. A method according to claim 17, wherein the liquid is applied to the web at several successive points (6, 10; 7).

19. A method according to claim 18, wherein the liquid is applied alternatingly from above and from below the web.

20. A method according to claim 1, wherein the solids content of the ingoing web (5)is about 0.5-4.0% and the solids of the outgoing web prior to its entry into the dryer is about 20-30%.

* * * * *